United States Patent [19]

Zeigler

[11] Patent Number: 4,761,929

[45] Date of Patent: Aug. 9, 1988

[54] COLLAPSIBLE/EXPANDABLE STRUCTURAL FRAMEWORKS

[76] Inventor: Theodore R. Zeigler, 3333 McKinley St., Washington, D.C. 20015

[21] Appl. No.: 656,937

[22] Filed: Oct. 2, 1984

Related U.S. Application Data

[63] Continuation-in-part of Ser. No. 458,364, Jan. 17, 1983, Pat. No. 4,473,986.

[51] Int. Cl.[4] ..... E04H 12/14

[52] U.S. Cl. ..... 52/646; 52/81

[58] Field of Search ..... 52/109, 641, 645, 648, 52/650, 646, 81; 403/11, 174, 178; 446/102, 104, 126

[56] References Cited

U.S. PATENT DOCUMENTS

| | | | |
|---|---|---|---|
| 2,140,283 | 12/1938 | Faber | 52/648 X |
| 3,220,152 | 11/1965 | Sturm | 52/648 |
| 3,364,633 | 1/1968 | Polo | 52/648 X |
| 3,407,560 | 10/1968 | Baumann | 52/648 X |
| 3,521,421 | 7/1970 | Schroeder | 52/648 |
| 3,557,500 | 7/1968 | Schmidt | 52/109 |
| 4,381,636 | 5/1983 | Sapp | 52/648 |
| 4,473,986 | 10/1984 | Zeigler | 52/645 |
| 4,479,340 | 10/1984 | Alphonse et al. | 52/646 |

OTHER PUBLICATIONS

*Space Grid Structures,* John Borrego, MIT Press, 1968, pp. 32–33.

*Primary Examiner*—Carl D. Friedman

*Attorney, Agent, or Firm*—John P. Snyder

[57] ABSTRACT

A plurality of struts are joined by hubs so as to be movable between a bundled, collapsed condition and an expanded condition in which the struts define at least one generally polyhedral or polygonal body. Pairs of the hubs are superposed to define split hub assemblies to hold the framework in expanded condition when joined.

30 Claims, 12 Drawing Sheets

FIG.1
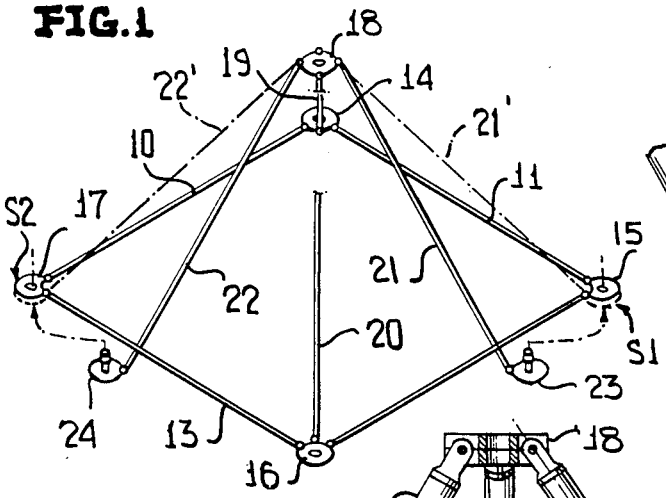
FIG.2
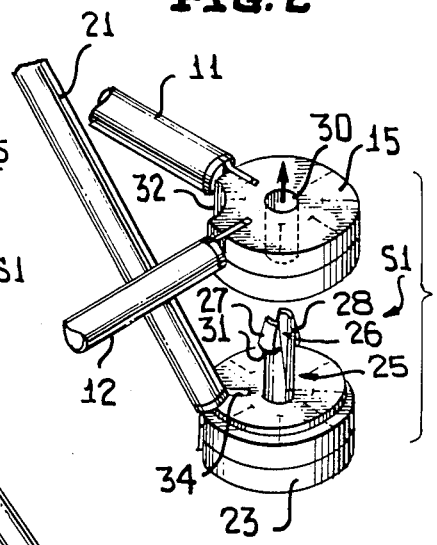
FIG.3
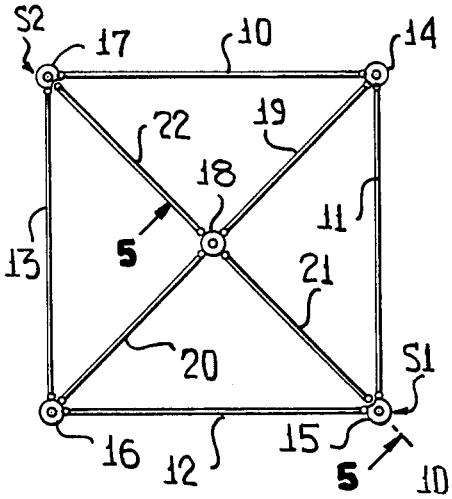
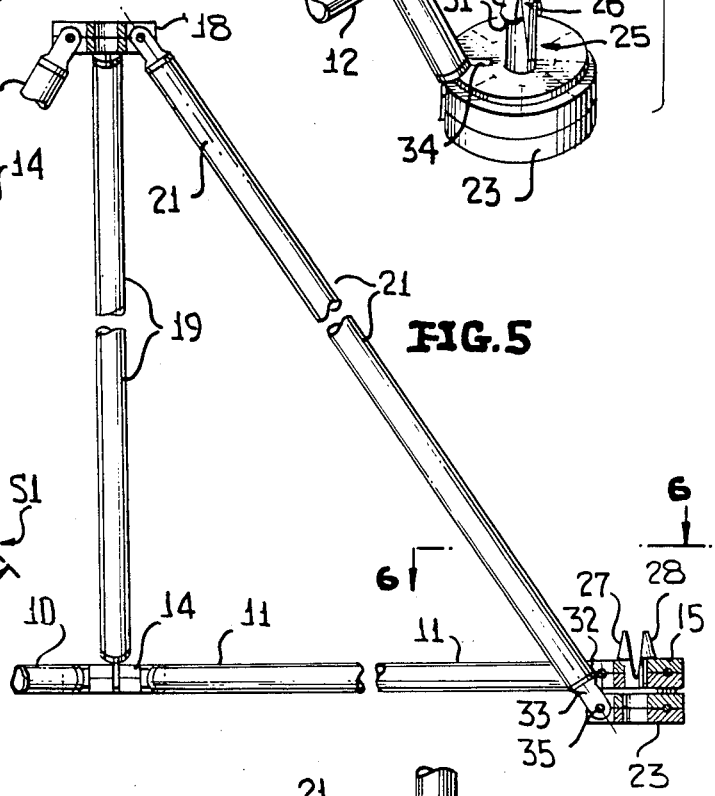
FIG.5
FIG.4
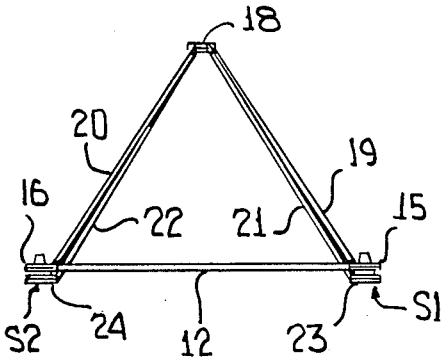
FIG.6
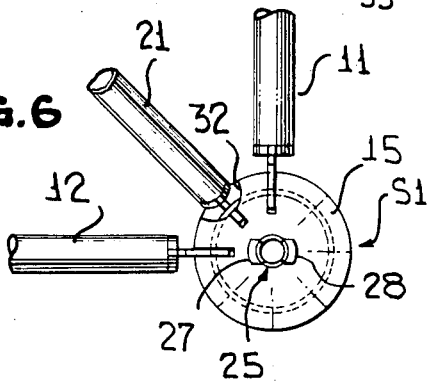

403
404
265
213
405
406
411
412
413
414
415
417
418
236
423
424
425
426
427
428
429
430
431
432
443
449
450, 451, 452
440, 441
442
444, 445, 446
447, 448
I
II

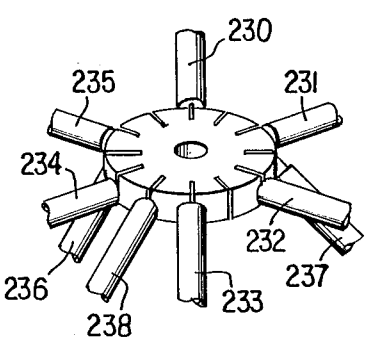
FIG. 16a
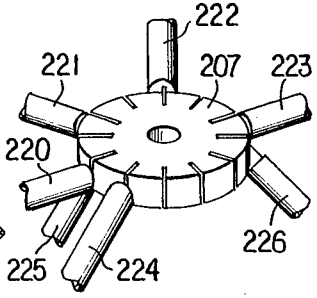
FIG. 16b
FIG. 16c
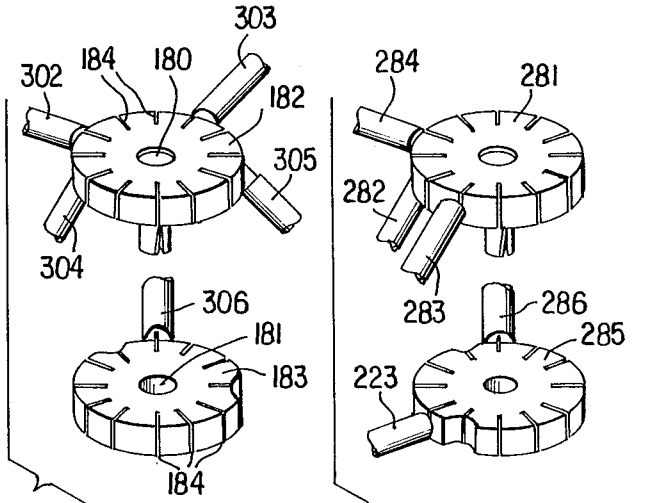
FIG. 17a
FIG. 17b
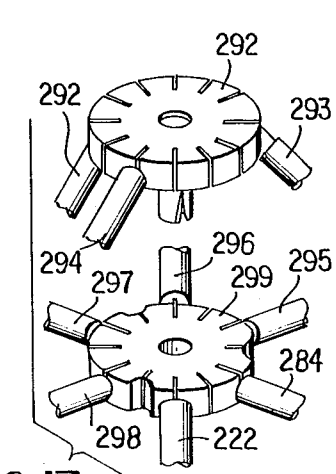
FIG. 17c
FIG. 17d
FIG. 17e
FIG. 17f
FIG. 17g

COLLAPSIBLE/EXPANDABLE STRUCTURAL FRAMEWORKS

CROSS REFERENCE TO RELATED APPLICATION

This application is a Continuation-In-Part of my copending applciation Ser. No. 458,364, filed Jan. 17, 1983 and now U.S. Pat. No. 4,473,986 issued Oct. 2, 1984. The subject matter of that patent is incorporated herein by reference.

BACKGROUND OF THE INVENTION

This invention is concerned with structural frameworks which are in the form of rod elements pivotally joined by hub means so that the framework may be collapsed into a compact bundle of rod elements and may be expanded into a frame. Devices of this general type are the subject of my prior U.S. Pats. Nos. 3,968,808; 4,026,313; 4,290,244 and 4,280,521; and 4,437,275. In all of these patents, the structures are "self supporting", i.e., they are characterized by the fact that structural integrity in the expanded form is achieved by stresses induced in the framework incidental to being expanded to full shape or form, without the aid of or necessity for any extraneous locking means. The Derus original U.S. Pat. No. 4,276,726 and its reissue Re. 31,641 also disclose an arrangement which achieves lock-up not by the aforesaid self-supporting action, but by means of a releasable locking link which is used to hold the structure in fully expanded form. A module of this latter configuration involves a circumscribing series of pairs of crossed rod elements which are pivotally joined in scissored fashion. In collapsed form, these scissored pairs of rod elements form a bundle and in expanded form they described, in zig-zag fashion, the side boundaries of a rectangular parallellepiped. The ends of the zig-zag related rod elements are joined by hub means, one group of which defines the corners of a square in one plane and the other group of which defines the corners of sa second square in a second plane close to the first plane. Radiating inwardly from the corners defined by one group of hubs are a series of further rod elements whose inner ends are joined by a further hub. When the structure has been expanded, the releasable locking means prevents collapse of the structure by preventing the planes containing the two groups of hub means from moving apart.

BRIEF SUMMARY OF THE INVENTION

This invention relates to collapsible/expandable frameworks which when expanded are releasably locked by means of split hub assemblies.

More specifically, the present invention relates to a structural framework capable of being manipulated between a collapsed, bundled condition ultimately to an expanded, releasably locked condition presenting a rigid, threedimensional space frame, the releasable locking being effected by the presence of cooperating hub means which form split hub assemblies.

In one aspect, this invention relates to a structural framework which initially is in the form of a collapsed bundle of generally parallel rods or struts, is expandable to a two dimensional configuration with locking by split hubs, and is further expandable with split hub locking into a three dimensional framework.

In another aspect, this invention relates to a structural framework which initially is in the form of a collapsed bundle of generally parallel rods or struts, is expandable directly to a three dimensional framework comprised of a plurality of generally pentahedral forms with split hub locking. The rods or struts which define the generally pentahedral forms may form substantially the whole or only part of the framework. For example, the generally pentahedral forms may be joined by bridging struts or rods which, dependent upon their lengths, may impart either a generally flat or a shaped configuration to the framework.

Generally pentahedral forms may be joined base-to-base within the framework so as to define generally octahedral forms therewithin. Opposite peaks of such generally octahedral forms may lie in opposite principal side surfaces bounding principal surfaces of the framework. Alternatively, such opposite surfaces may be defined generally by opposite triangular sides of the generally octahedral forms together with generally triangular faces of substantially tetrahedral forms.

In a further aspect of the invention, same relates to a collapsible/expandable framework locked by split hub assemblies and which is characterized by a "packed" format comprising generally pentahedral forms associated with generally tetrahedral forms. By "packed" is meant that the polyhedral forms are so nested relative to each other as to occupy or encompass all of the volume within the framework, adjacent polyhedral forms sharing common rods or struts.

In the simplest form, the framework is constructed of generally pentahedral forms joined by generally tetrahedral forms. In this form, the bases of the generally pentahedral framework whereas the base of at least one further generally pentahedral form defines an opposite side surface and with a cluster of generally tetrahedral forms filling in or packing the volume around the generally triangular sides or faces of the latter-mentioned generally pentahedral form of body.

In another form of the invention, the bases or pairs of generally pentahedral forms are joined or shared to form generally octahedral forms or bodies, the peaks of such generally octahedral forms lying on opposite principal side surfaces of the framework. These peaks are joined on each of such principal surfaces by rods or struts which define the base of at least one further generally pentahedral body or form at each such surface and clustered around these lattermentioned generally pentahedral forms or bodies are clusters of generally tetrahedral bodies or forms to complete the packing of the volume bounded by the framework.

In still another form of the invention, the bases of the generally pentahedral forms defining the generally octahedral bodies extend generally diagonally between the opposite side principal surfaces defined by the framework and the generally tetrahedral forms which complete the packing have generally triangular faces lying in respective ones of these principal opposite side surfaces.

These and other objects of the invention will become more apparent as this description proceeds.

BREIF DESCRIPTION OF THE DRAWING FIGURES

FIGS. 1–6 are identical with corresponding Figures of my copending application, now U.S. Pat. No. 4,473,986 and incorporated herein by reference;

FIG. 7 is a diagrammatic plan view illustrating certain principles of this invention;

FIGS. 7 *a–f* are perspective views of certain of illustrative hubs;

Figure 18:
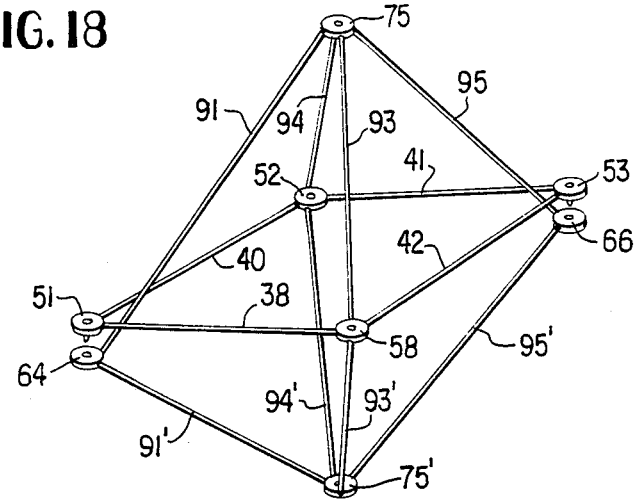
Figure 19:
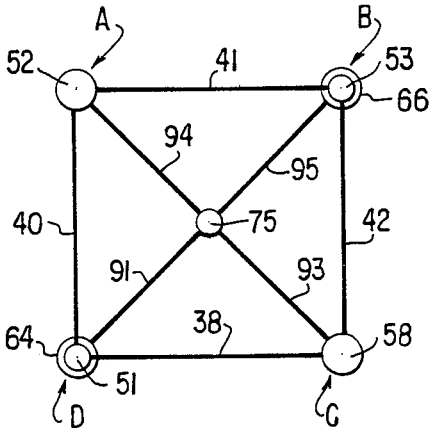
Figure 20:
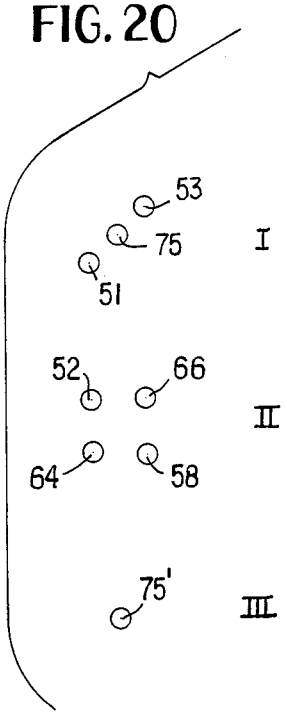
Figure 21:
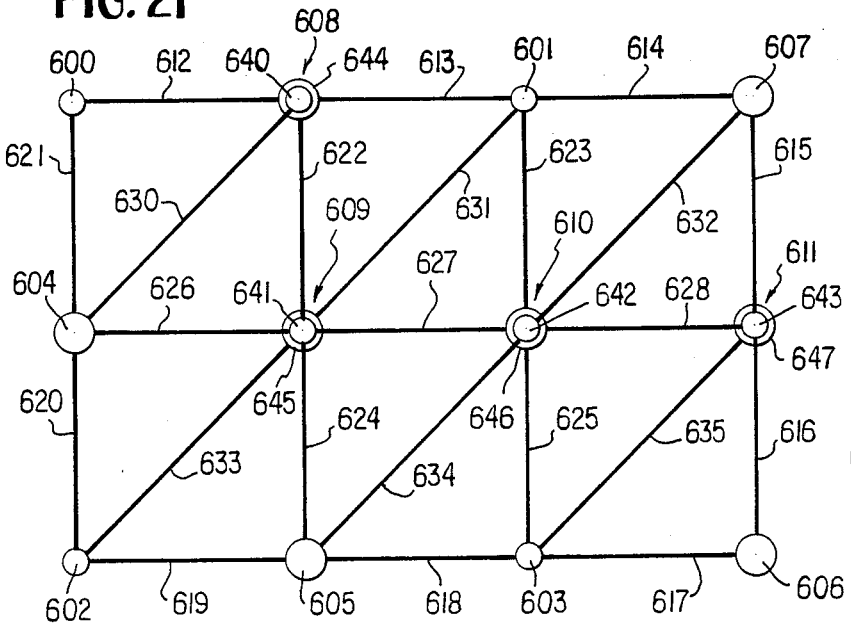
Figure 22:
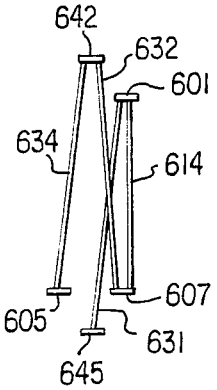
Figure 23:
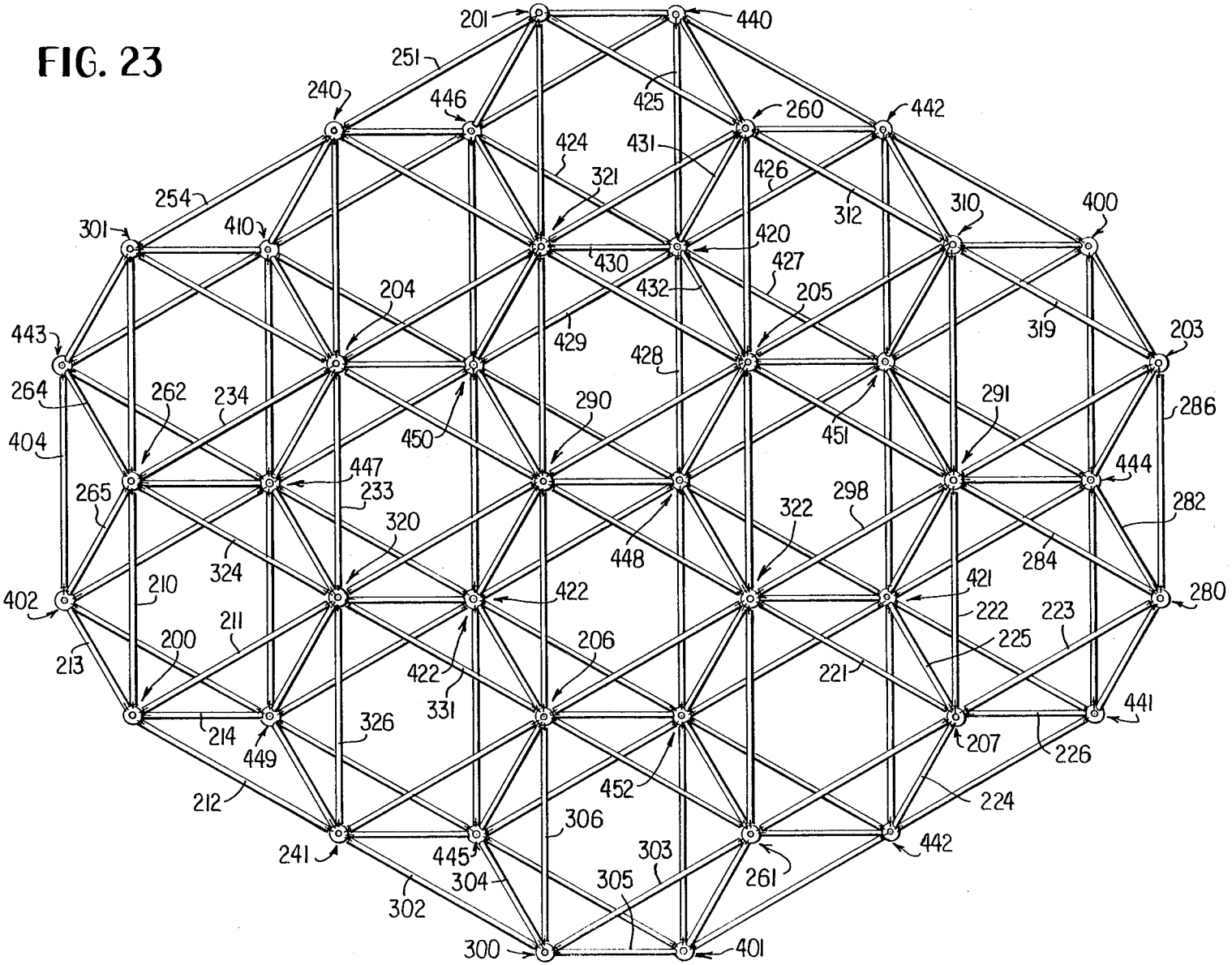
Figure 24:
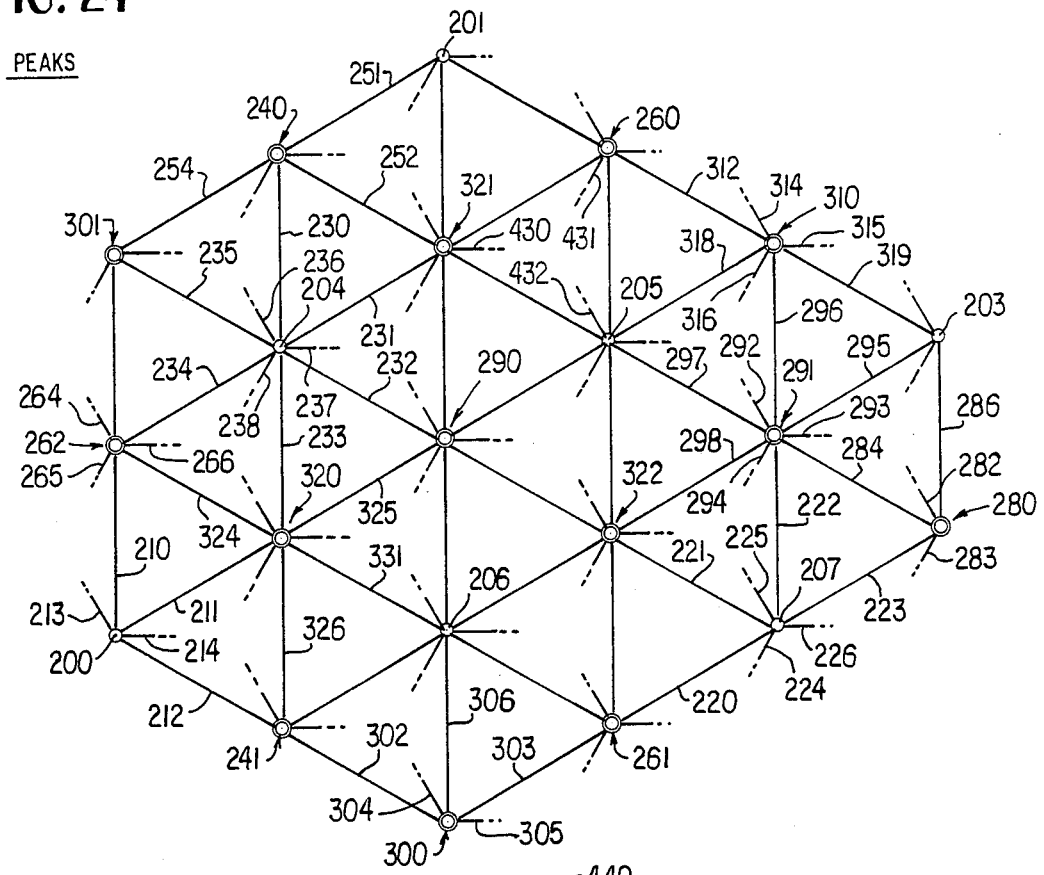
Figure 25:
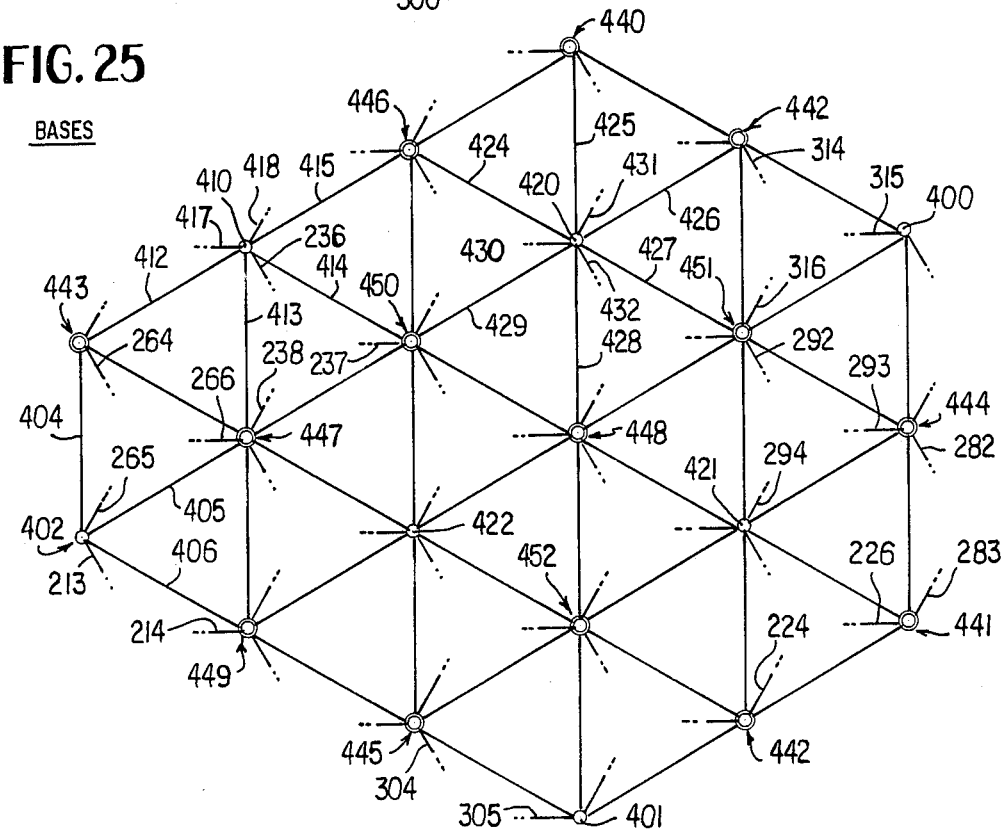
Figure 27:
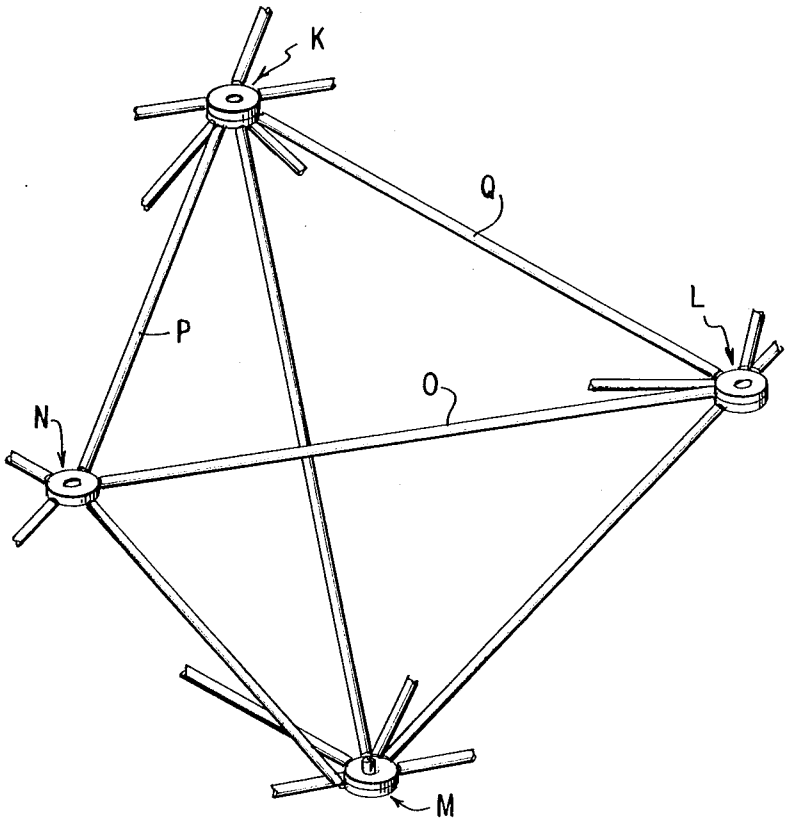
Figure 26:
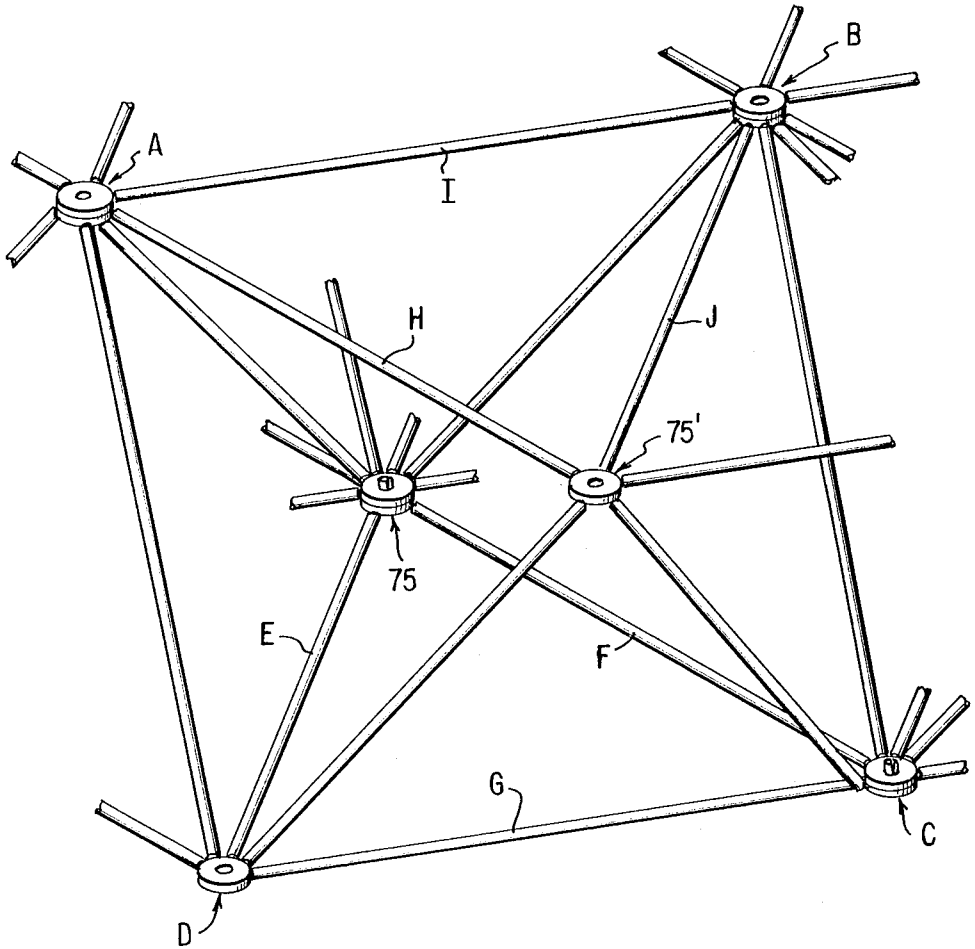

FIGS. 14 *a–c* and 15 *a–g* illustrate various forms and arrangements of the hubs;

FIGS. 16 *a–c* and 17 *a–g* illustrate various forms and arrangements of the hubs;

FIG. 18 is a perspective view of an expanded octahedral form just prior to joining the split hubs;

FIG. 19 is a plan view of the octahedral form;

FIG. 20 is a diagram illustrating the relative positions of the hubs of the assembly of FIGS. 18 and 19;

FIG. 21 is a diagrammatic plan view of a framework expanded to two dimensional form;

FIG. 22 illustrates relative positions of the hubs of the FIG. 21 assembly when collapsed;

FIG. 23 is a plan view of a framework of another embodiment of the invention;

FIGS. 24 and 25 are plan views of the dispositions of the hubs in each of the opposite principal side surfaces of the embodiment of FIG. 23;

FIG. 26 is a partial perspective view illustrating one octahedral form or body in the embodiment of FIGS. 23–25; and FIG. 27 is a partial perspective view illustrating one tetrahedral form or body in the embodiment of FIGS. 23–25.

DETAILED DESCRIPTION OF THE INVENTION

As noted above, FIGS. 1–6 are reproduced from my copending application and are repeated here to illustrate a basic module of this invention which has the form of a pyramid or pentahedron. As shown in FIGS. 1 and 3, the rods or struts 10, 11, 12 and 13 joined to the respective hubs 14, 15, 16 and 17 form the base of the pentahedral form or body. The rods 19, 20, 21 and 22 are joined to the peak hub 18, each at one end while the two struts 19 and 20 are joined at their opposite ends to the previously mentioned hubs 14 and 16. The rods 21 and 22, on the other hand are connected to the two hubs 23 and 24 which form the respective split hubs S1 and S2 or pairs with the hubs 15 and 17. The general configuration of the split hubs are illustrated in FIGS. 2, 4, 5 and 6 and the detailed description of same is incorporated herein by reference.

Before passing on to other Figures, it will be appreciated that the struts 10–13 are preferably of the same length and it is also preferred that the struts 19–22 are also of this same length. This makes for greater economy and simplicity in manufacture and assembly. It will also be appreciated that when in collapsed, bundled form where all of the rods are generally parallel and lie rather closely together, the three hubs 17, 18 and 15 will lie at one end of the bundle whereas all of the other hubs will lie at the other end of the bundle. As the bundle is expanded, the four hubs 14–17 will assume a position in which they are substantially coplanar and with the hubs 15 and 17 overlying and in coupled contact with the hubs 23 and 24. Thus, although the module is of pentahedral form, it is not strictly in that shape, see particularly FIGS. 4 and 5.

A FRAME PACKED WITH PENTAHEDRAL AND TETRAHEDRAL FORMS OR BODIES

Figure 7:
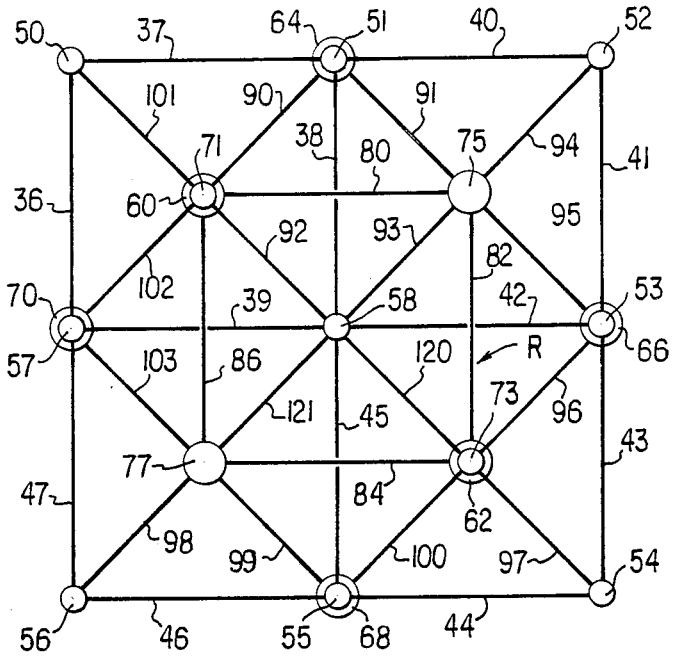

FIG. 7 illustrates a basic framework which may be extended or enlarged horizontally or vertically. As shown, four pentahedral forms are arranged so that their bases lie generally on one principal side surface of the volume defined with the framework, a further pentahedral form is inverted with respect to these four so that its base lies generally on the opposite principal side surface and, lastly, there are four tetrahedral forms or bodies which are clustered around the four generally triangular side faces of this latter octahedral form so as to "fill" or "pack" the volume occupied or enclosed by the framework. In FIG. 7, the view is in plan so that the underlying principal side surface is defined generally by the bases of the four pentahedral forms.

Thus, the four struts 36–39 define the base of the first form, the struts 40–42 plus the previously mentioned strut 38 define the base of the second form, the struts 43–45 plus the previously mentioned strut 45 define the base of the third form, and the struts 46 and 47 plus the previously mentioned struts 39 and 45 define the base of the fourth form.

The strut 37 connects from the hub 50 to the hub 51, through the strut 40 to the hub 52, through the strut 41 to the hub 53, through the strut 43 to the hub 54, through the strut 44 to the hub 55, through the strut 46 to the hub 56, through the strut 47 to the hub 57, and through the strut 36 back to the hub 50. The several struts 38, 39, 42 and 45 join the respective hubs 51, 57, 53 and 55 to the central hub 58. When the framework is in the collapsed, bundled condition, all of the hubs 50, 52, 54, 56 and 58 are grouped at one end (lower) of the bundle of rods or struts, together with the hubs 60, 62, 64, 66, 68 and 70, all as shown in the upper portion of FIG. 8. The hubs 60–70 are underlying hubs of split hub assemblies, i.e., are paired with the hubs 71, 73, 51, 53, 55 and 57. The hubs 51, 53, 55, 57, 71, 73, 75 and 77 are grouped at the other end (upper) of the bundle in the collapsed condition of the framework as shown in the lower portion of FIG. 8.

The four struts 80, 82, 84 and 86 are the base struts of an inverted pentahedral form whose apex hub is the hub 58. Clustered around the four triangular sides of this latter pentahedral form are four tetrahedral forms. To illustrate, the side of a tetrahedral form bounded by the struts 80, 90 and 91 (i.e., one triangular face) is a first face, the side bounded by the struts 80, 92 and 93 is a second triangular face, the side bounded by the struts 91, 93 and 38 is a third triangular face, and the side bounded by the struts 38, 90 and 92 is a fourth triangular face.

This "packing" of the volume encompassed by the framework is very important for rigidity, particularly since the tetrahedral configuration is extremely stable. By "packing" is meant that the entire volume is filled. One edge surface of the volume filled is the generally trapezoidal surface bounded generally by the struts 41 and 43 as the base, the strut 82 as the top and the struts 94 and 97 and the ends. The struts 95 and 96 also lie generally in this trapezoidal surface. The next trapezoidal side edge surface is bounded top and bottom by the strut 84 and the struts 44, 46 and with the ends by the struts 97 and 98, the struts 99 and 100 lying also generally in tis second trapezoidal side edge surface. The third trapezoidal side edge surface is bounded by the strut 86, the struts 36 and 47, the strut 98 and the strut 101 with the struts 102 and 103 also lying generally in this third trapezoidal surface. The fourth side edge trapezoidal surface is bounded by the strut 80, the struts 37 and 40, the strut 99 and the strut 94, with the struts 90 and 91 also lying generally in this side surface.

The two principal side surfaces are the top and bottom surfaces in FIG. 7, the top surface being as bounded generally by the four base struts 80, 82, 84 and 86 and the bottom surface being as bounded by the struts 36, 37, 40, 31, 43, 44, 46 and 47 and within which principal surface the struts 38, 39, 42 and 45 also generally lie. The peak hubs for the four pentahedral forms are the hubs 71, 75, 73 and 77 and, as noted previously, the peak hub for the inverted pentahedral form is the hub 58.

Figure 9:
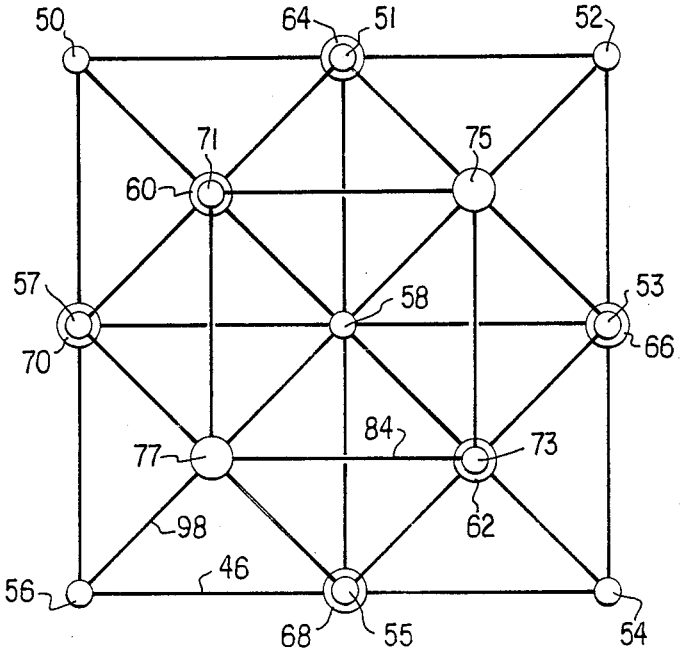
FIG. 9 is a view similar to FIG. 7 but showing a modification.
Figure 10:
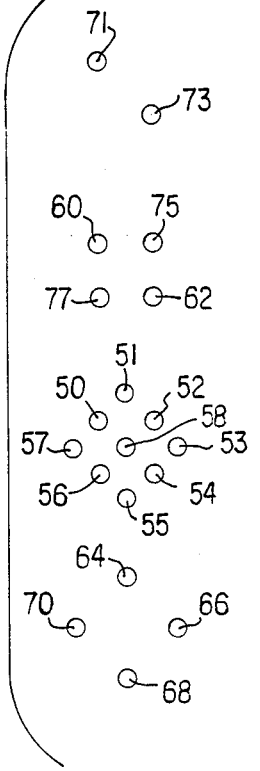
FIG. 10 is a diagram illustrating the relative positions of the hubs of the assembly of FIG. 9 when collapsed.

FIG. 9 illustrates the same general framework as in FIG. 7 but in this instance, there are four groups of hubs, as shown in FIG. 10. Thus, FIGS. 9 and 10 illustrate that the movements of the hubs may be rearranged by changing the strut connections to the pairs of hubs forming each split hub assembly. For clarity, the same reference characters are used both for hubs and for struts in FIGS. 7 and 9. A few simple examples should suffice to illustrate the strategy.

Thus, in FIG. 9, the peak hubs for the four pentahedral forms are the hubs 60,75 62 and 77 rather than, as in FIG. 7, the hubs 71, 75, 73 and 77. This reversal in connection to the split hubs 60, 71 and 62, 73 causes the bundled rods (i.e., collapsed condition) to position the hubs 71 and 73 uppermost as shown at the top of FIG. 10. Similarly, strut connections at the split hubs 51, 64 and 53, 66 and 55, 68 and 57, 70 are reversed. This causes the group of hubs 64, 66, 68 and 70 to be positioned lowermost in the bundle (bottom of FIG. 10) and also causes two other groups of hubs to be formed as shown at II and III of FIG. 10. The rule which is followed in all cases is that each rod or strut must be connected at its opposite ends with hubs which are separated (when bundled) by one tier. To illustrate, the tier I hub 73 is connected to one end of the strut 84 so that the hub 77 must belong to tier II. Similarly, the strut 98 connects the tier II hub 77 to a tier III hub 56 and, lastly, the strut 46 connects the tier III hub 56 to a tier IV hub 68. In FIG. 7, the connections are made back and forth between tiers I and II. This leads to a rather dense bundle but it has the advantage of being of a length equal to the strut length. In FIG. 9, a much more girthwise compact bundle is formed but its length is three times the strut length. A three tier bundle is also possible by using the split hub connections 60 and 71, and 62, 73 as shown in FIG. 9 in the FIG. 7 arrangement.

Figure 11:
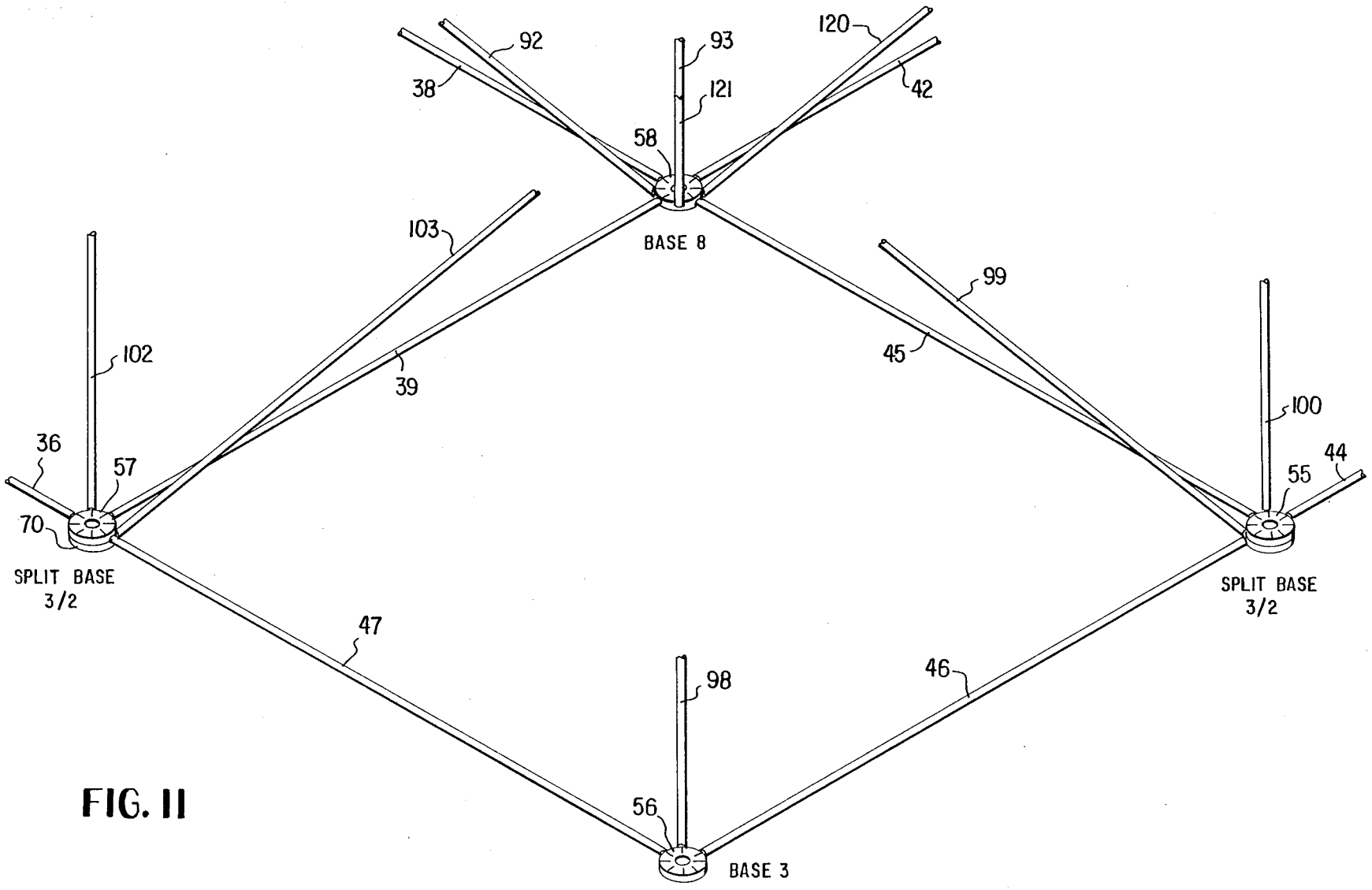
FIGS. 11–13 are perspective views of various portions of an assembly such as FIG. 7.
Figure 12:
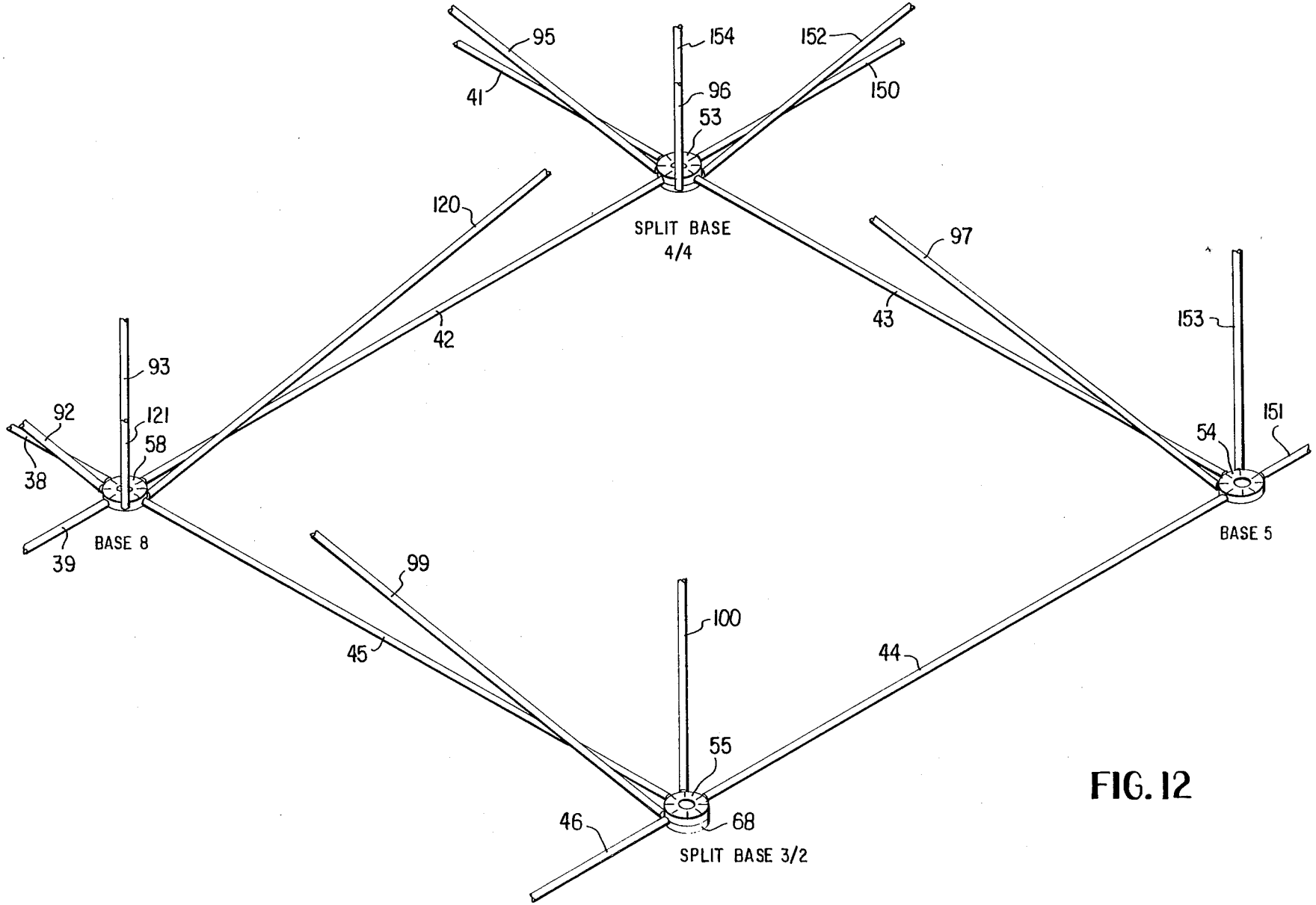
Figure 13:
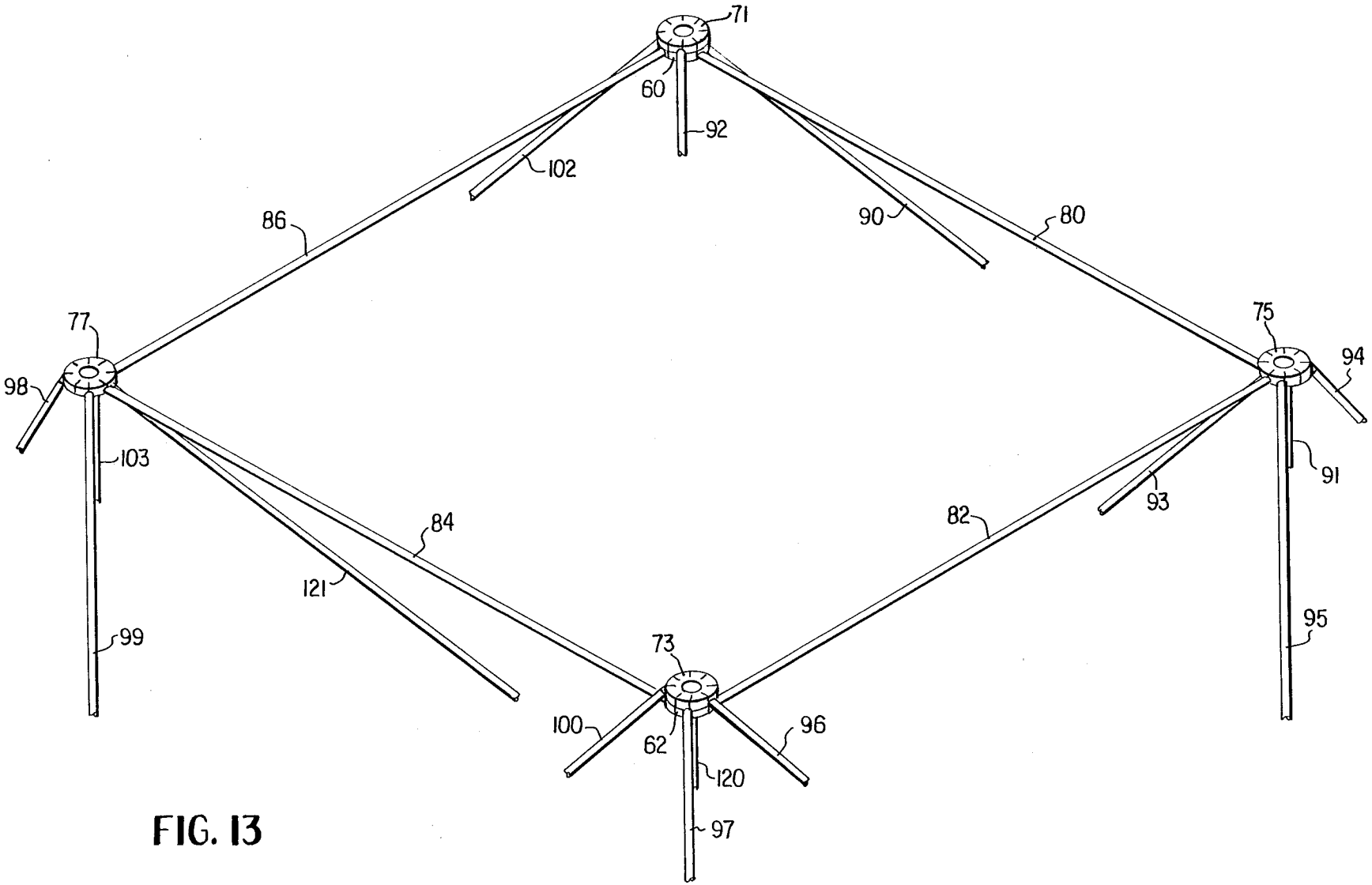

FIGS. 11–13 illustrate a portion of a framework constructed in accord with FIG. 7. FIG. 11 is a perspective view of the "base" hubs, i.e., those lying on the bottom principal side surface.

Figure 7C:
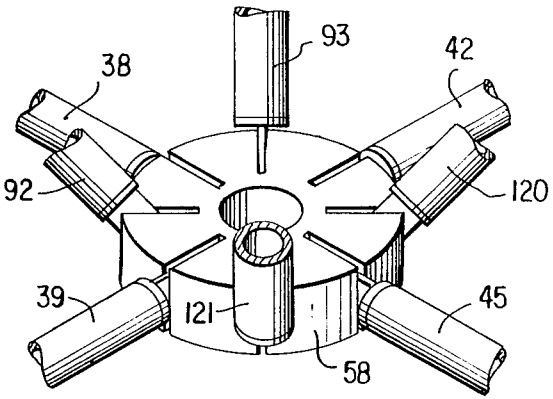
Figure 7B:
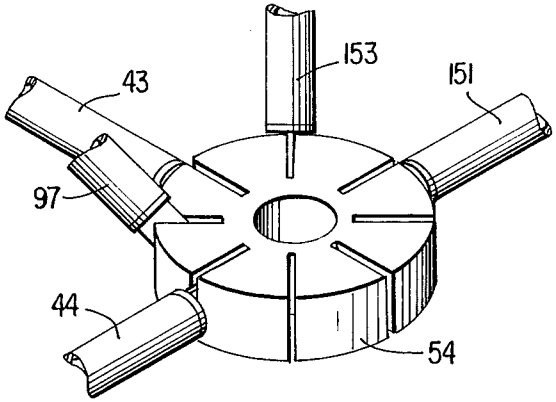
Figure 7A:
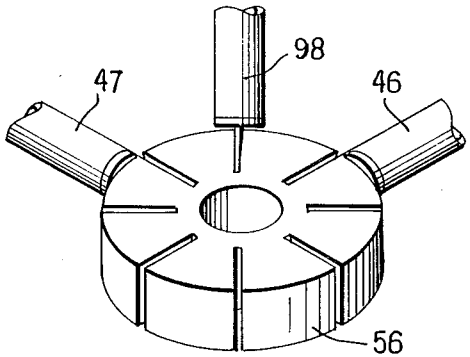

FIGS. 7 *a–f* are illustrative of various types of hubs involved. For example, the hub 56 is of the type shown in FIG. 7*a*, the hub 58 is of the type shown in FIG. 7*c*, and the split hub assemblies 57, 70 and 55, 68 are of the type shown in FIG. 7*e* to which reference characters corresponding to the latter have been applied.

Figure 7F:
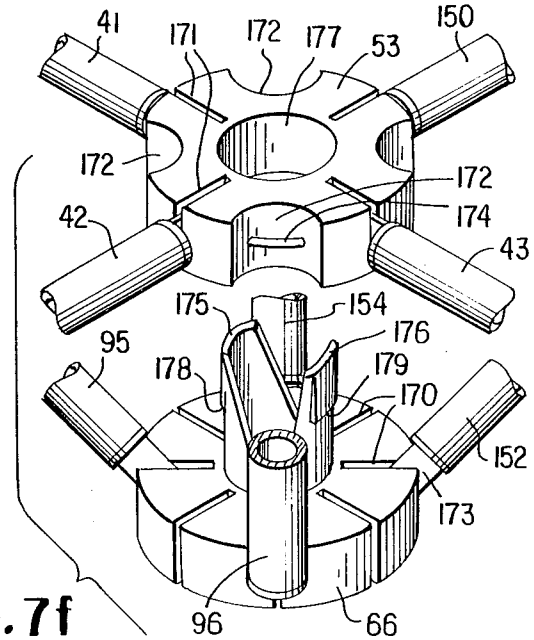
Figure 7E:
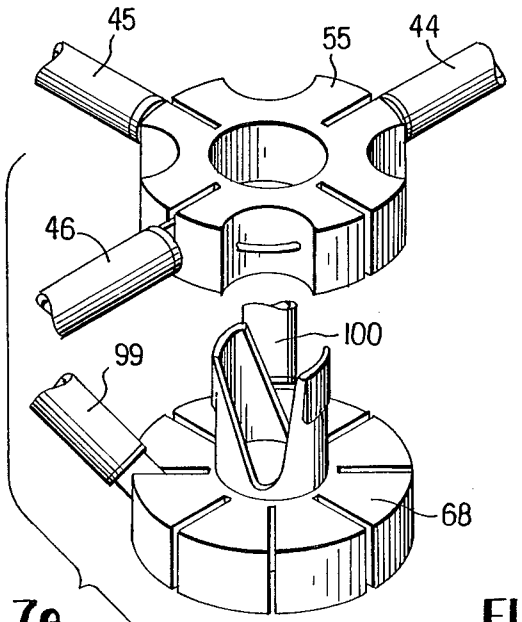
Figure 7D:
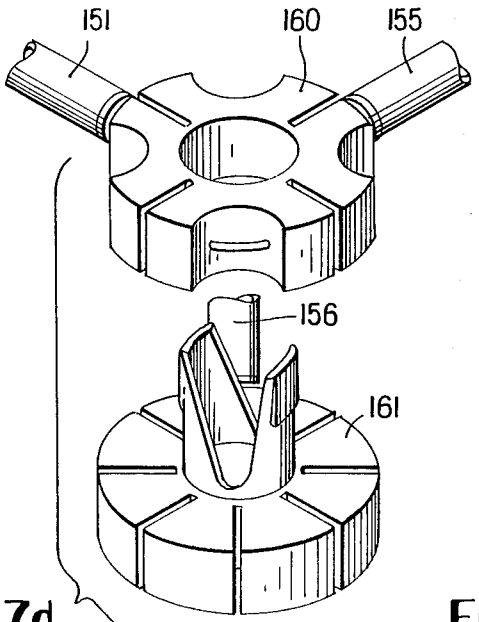

In FIG. 12, an addition or extension is illustrated with respect to the right-hand side of FIG. 7. Thus, the additional base struts 150 and 151 as shown plus two of the side struts 152 and 153 of the associated pentahedral form and the side struts 154 of a still further pentahedral form. The hub 54 is of the type shown in FIG. 7*b* and the split hub 53, 56 is shown in FIG. 7f. The split hub of FIG. 7*d* is a corner hub is the aforesaid extension merely adds two more pentahedral forms to the right-hand side of FIG. 7. Thus, as shown in FIG. 7d, the base strut 151 and a further base strut 155 (which would be parallel to 43 in FIG. 12) are connected to the hub 160 whereas the side edge strut 156 would be connected to the lower hub 161. The struts 152, 153 and 156 plus another strut not illustrated would join with a peak hub of the associated pentahedral form whose base struts are 43, 150, 151 and 155.

The various hubs of FIGS. 7 *a–f* and, for that matter, the hubs of FIGS. 14 *a–c*, 15 *a–g*, 16 *a–c* and 17 *a–g* are of the ring and blade type according to the disclosure of my prior U.S. Pat. No. 4,280,521. In FIGS. 7 *a–f*, eight slots 170 are provided in the single hubs and in the bottom hubs of a split assembly, see FIG. 7*f*. The upper hubs of a split assembly are provided with four slots 171 and intervening notches 172. A blade is indicated at 173 (see strut 152) and the ring 174 is shown in Hub 53 exposed at a notch 172. The notches 172 are for the purpose of clearing the struts 95, 96, 152 and 154, for example as in FIG. 7*f*. The bottom hub of a split assembly may be provided with a bifurcated nose whose parts 175 and 176 are adapted to squeeze together when entering the central hole 177 of an upper hub (see FIG. 7*f*) and then snap apart when the two hubs 53 and 66 come into face-to-face contact so that the locking edges 178 and 179 engage against the top surface of the hub 53.

The split hubs of FIGS. 15 *a–g* employ a similar locking arrangement but those of FIGS. 17 *a–g* do not illustrate a locking nose and are intended to demonstrate that other and different locking arrangements can be used, for example a bolt and nut arrangement through the center holes 180, 181 of the upper and lower hubs 182, 183 shown in FIG. 17*a*. The hubs of FIGS. 14 *a–c*, 15 *a–g*, 16 *a–c* and 17 *a–g* all have twelve slots 184 for purposes which will presently be apparent.

FIG. 13 illustrates the top side of the framework of FIG. 7 in perspective, the reference characters being those used in the latter Figure. It should be noted that the various peak hubs are inverted versions of the hubs shown in FIGS. 7 *a–f*. Thus, the hub 73 of the split hub 73, 62 is an inverted version of the hub 66 in FIG. 7f whereas the hub 62 becomes the lower hub but similar to the hub 160 in FIG. 7*d*, etc.

PENTAHEDRAL, OCTRAHEDRAL AND TETRAHEDRAL PACKING

A structure generally arranged as in FIG. 7 may be modified by integrating two such structures so that four of the pentahedral forms become octahedral forms. Such an arrangement is shown in FIGS. 18 and 19. The reference characters employed in FIG. 7 are used to denote the base struts 38, 40, 41 and 42, the single hubs 52, 58 and 75, the split hubs 51, 64 and 53, 66, and the side edge struts 91, 93, 94 and 95. The inverted pentahedral structure includes the peak hub 75' and the side edge struts 91', 93', 94' and 95' and shares the base hubs 52 and 58 and 51, 64 and 53, 66 as well as the corresponding base struts 38, 40, 41 and 42. The upper, middle and lower groups of hubs when the structure is collapsed are illustrated as the respective three tiers I, II and III in FIG. 20.

It should be noted that two clusters of generally tetrahedral forms are disposed within such a modified structure of FIG. 7, one around the two peak-to-peak joined (at hub 58) pentahedral forms, one of whose base struts are 80, 82, 84 and 86 in FIG. 7 and the other of whose base struts would be mirrored on the bottom side. Thus, this modification in reality is packed with octahedral forms, pentahedral forms and tetrahedral forms.

A FRAME PACKED ONLY WITH OCTAHEDRAL AND TETRAHEDRAL FORMS

FIG. 23 shows such a framework. Again, the structure starts out as a bundle of rods or struts, the grouped hubs being in at least three tiers.

For convenience, the peak hubs are shown in plan in FIG. 24 whereas the base hubs are shown in plan in FIG. 25. All hubs are of the twelve-slot type as shown in FIGS. 14 *a–c*, 15 *a–g*, 16 *a–c* and 17 *a–g*.

With reference to FIG. 24, there are twenty-one hub positions shown, of which there are seven single hubs and fourteen split hub pairs. The single hubs 200, 201 and 203 each join five struts, the three single hubs 204, 205 and 206 join nine struts each and the hub 207 joins seven struts. As is clearly evident, the hubs 200, 201 and 202 are identical as are the hubs 204, 205 and 206. Selecting the hub 200, it will be seen that the three struts 210, 211 and 212 intersect same generally in the same plane whereas two upwardly angled struts 213 and 214 are also intersecting. This pattern is the same for all the hubs 200, 201 and 203 and will be seen to be shown in FIG. 16a. The hub 207 joins the generally planar struts 220, 221, 222 and 223 and the inclined struts 224, 225 and 226, this pattern being shown in FIG. 16*b*. The hub 204 joins six generally coplanar struts 230, 231, 232, 233, 234 and 235 and three inclined struts 236, 237 and 238. The pattern for the hubs 204, 205 and 206 is illustrated in FIG. 16*c*.

As for the split hub pairs, the two pairs 240 and 241 are the same as shown in FIG. 17*e*, comprising the upper hub 243 to which the two upwardly inclined struts 244 and 245 are connected and the lower hub 250 to which the generally coplanar struts 251, 252, 230 and 254 are connected.

The split hub pairs 260, 261 and 262 are as illustrated in FIG. 17*f*. Considering the hub pair 262, it comprises the upper hub 263 to which the upwardly inclined struts 264, 265 and 266 are connected, and the lower hub 270 to which the generally coplanar struts 210, 271, 234 and 272 are connected.

The split hubs 280 are of the pattern shown in FIG. 17*b*. The upper hub 281 connects the inclined struts 282 and 283 as well as the generally horizontal strut 284 whereas the lower hub 285 connects the remaining two generally horizontal or generally coplanar struts 223 and 286.

The two split hub sets 290 and 291 are of the type illustrated in FIG. 17*g*. The upper hub 292 connects the upwardly inclined struts 292, 293 and 294 whereas the lower hub 299 connects the generally coplanar struts 222, 284, 275, 296, 297 and 298.

The split hubs 300 and 301 are of the form shown in FIG. 17*a*. The upper hub 182 connects the two generally coplanar struts 302 and 303 and the two upwardly inclined struts 304 and 305 whereas the lower hub 183 connects to the remaining substantially coplanar strut 306.

The split hub pair 310 is of the form shown in FIG. 17*c*. The upper hub 311 connects the two generally coplanar struts 312 and 296, and the three upwardly inclined struts 314, 315 and 316 whereas the lower hub 317 connects the remaining two generally coplanar struts 318 and 319.

The remaining three peak split hub pairs 320, 321 and 322 are of the pattern illustrated in FIG. 17*d*. Referring to the pair 320, the upper hub 323 connects three of the generally coplanar struts 324, 325, 326 and the three upwardly inclined struts 327, 328 and 329 whereas the lower hub 330 connects the three substantially coplanar struts 331, 211 and 223.

Insofar as the peak hub positions are concerned, as noted there are twenty-one positions and, of these, there are seven singles and fourteen doubles, a total of thirty-five hubs. When the framework is collapsed, the single hub at each of the seven positions plus the uppermost hub at each of the fourteen split hub positions move upwardly to take a tier I position in the bundle. In addition, there are two uppermost hubs of two split pairs in the base hubs of FIG. 25 which swing upwardly to the tier I position. This makes a total of twenty-three hubs in the collapsed, tier II position.

At the fourteen split hubs in FIG. 24, each has a lowermost hub which swings to the tier II position when the framework is collapsed. In addition, there are twenty-one hubs in FIG. 25 which also swing up to the tier II position, making a total of thirty-five hubs which swing to the tier II position when the framework is collapsed. Finally, all but two of the fourteen split hub positions have the uppermost hub which is a tier II hub, making each underlying hub a tier III hub for a total of twelve tier II hubs. It will be appreciated that five tiers of hubs can be employed by making the appropriate reversals of strut connections at the split hub pairs. Conversely, only two tiers may be employed but this makes the framework difficult to collapse and the resultant bundle is rather loose and of substantial girth.

Figures 14A, 14B, 14C, 15A, 15B, 15C, 15D, 15E, 15F, 15G:
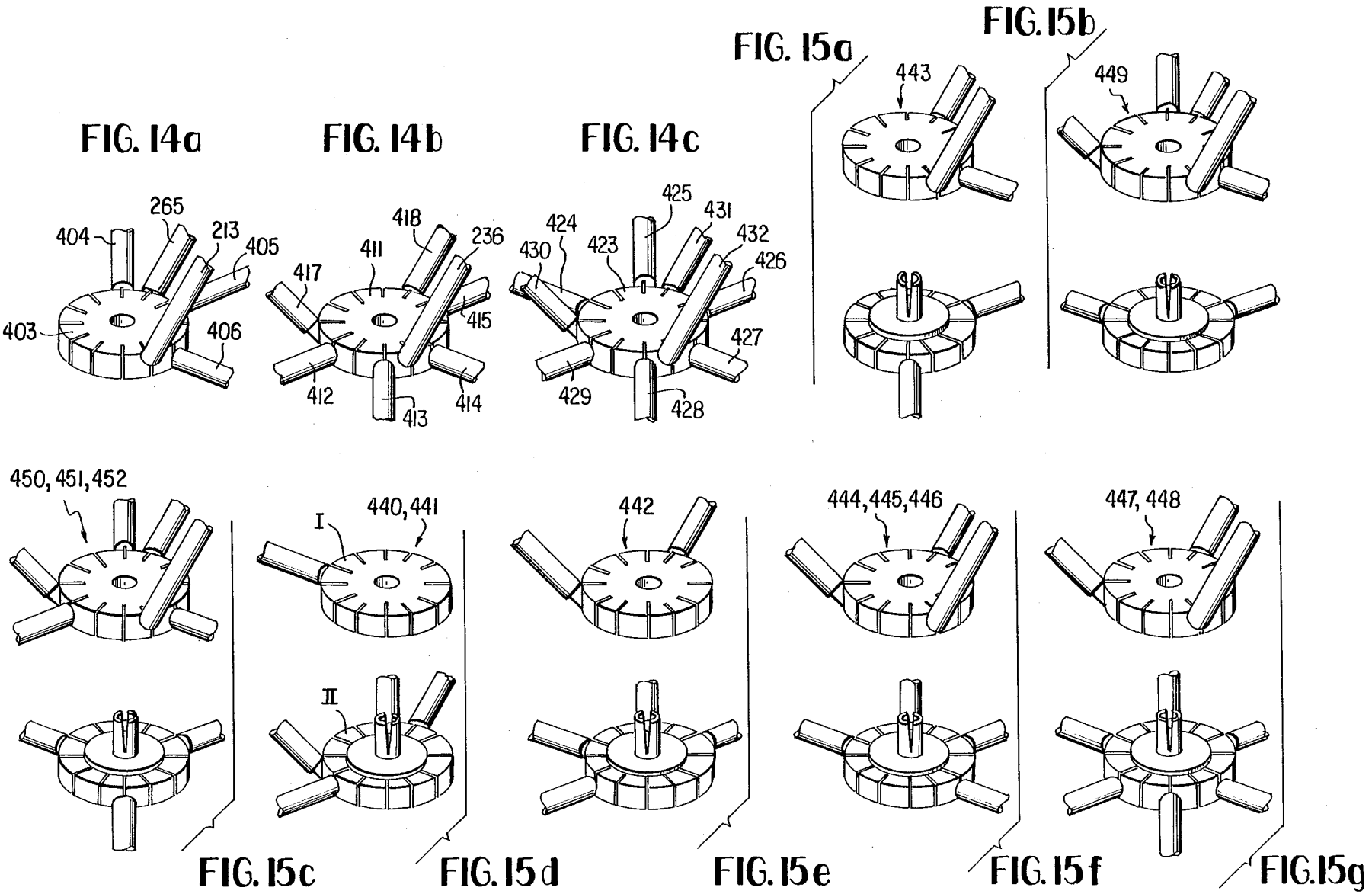

With reference to FIG. 25, the base hubs are illustrated therein and will be seen to comprise the three single hubs indicated generally by the reference characters 400, 401 and 402 each of which is of the configuration and pattern of FIG. 14*a* comprising a lower hub 403 to which are connected three generally coplanar struts 404, 405 and 406 and two upwardly inclined struts 265 and 213.

The hub 410 is shown in FIG. 14*b* and will be seen to include a hub 411 to which the four substantially coplanar struts 412, 413, 414 and 415 are connected and to which the upwardly inclined struts 236, 417 and 418 are also connected.

The three hubs 420, 421 and 422 are patterned in accord with FIG. 14*c*, each having a hub 423 which connects six generally coplanar struts 424, 425, 426, 427, 428 and 429. Additionally, the upwardly inclined struts 430, 431 and 432 are connected to the hub 423.

Whereas there are a total of seven single hubs in the base hub pattern, one of which is connected to seven struts, three of which are connected to five struts and three of which are connected to nine struts, there are fourteen split hub assemblies in the base hubs in FIG. 25, 440 and 441 are of the type illustrated in FIG. 15*d*, one of which indicated at 442 is of the pattern indicated in FIG. 15*e*, one of which as indicated at 443 is of the pattern indicated in FIG. 15*a*, three of which as indicated by the reference characaters 444, 445 and 446 are of the pattern illustrated in FIG. 15*f*, two of which as indicated by reference characters 447 and 448 are of the pattern illustrated in FIG. 15*g*, one of which is indicated by the reference character 449 is of the pattern illustrated in FIG. 15*b*, and the last three of which indicated by the reference characters 450, 451 and 452 are of the pattern indicated in FIG. 15*c*.

All of the hubs of FIGS. 14 *a–c* are tier II hubs; the two hubs of FIG. 15d are tier I and tier II hubs and all of the lower hubs in FIGS. *a–c, e–g* are tier III hubs whereas the upper hubs are tier II hubs. Similarly, all of the hubs of FIGS. 16 *a–c* are tier I hubs; all of the upper hubs of FIGS. 17 *a–g* are tier I hubs and all of the lower hubs of these Figures are tier II hubs.

Referring to FIGS. 26 and 27, the two polyhedral forms or bodies which are associated with the configuration of FIGS. 23–25 will be apparent. The number of different reference characters used in identifying the struts in FIGS. 24 and 25 has been limited to avoid crowding in FIG. 23. Even so, it is difficult to ascertain the various octahedral forms and tetrahedral forms in FIG. 23. FIG. 26 illustrates one of the fourteen "tipped" octahedral forms in the framework of FIG. 23. FIG. 27 illustrates one of the twenty-six tetrahedral forms packed in the framework, thirteen on the front side of FIG. 23 and thirteen on the rear side of that Figure. To illustrate, starting at the right-hand side of FIG. 23, the first front side tetrahedron is defined generally at the four peak hub positions 203, 280, 291 and 444. On the rear side, the hub positions are at 444, 421, 451 and 291, for example. For the octrahedral forms, the opposite peak hub positions (corresponding to 75, 75' in FIG. 18) would be the hub positions 421 and 280, for example. The base hub position (corresponding to A, B, C, D in FIG. 18) would be 207, 291, 444 and 441 for this example. To correlate the faces of this example with FIG. 26, it will be seen that the triangular face bounded generally by the struts E, F, G lies on the back principal face of FIGS. 23 and 26; the generally triangular face bounded by the struts H, I, J lies on the front or top principal face of FIGS. 23 and 26; and the remaining six generally triangular faces are bounded by the struts connecting hub positions B, C, 75'; hub positions C, D, 75'; hub positions A, D, 75'; hub positions A, D, 75'; hub positions A,D, 75; hub positions A, B, 75; and hub positions B, C, 75.

In FIG. 27, the hub positions K, L, M, N define with the struts passing between them the four generally triangular faces of the tetrahedral body or form. Of these four faces, only one lies on a front or back principal face, being in FIG. 27 that defined between K, L and N, the struts O, P, Q lying generally in such principal surface. It should be noted that in FIG. 7, for example, no face of a tetrahedral body lies on a principal surface but that one strut R does, being a base strut of a pentahedral body form.

A further embodiment is illustrated in FIGS. 21 and 22. The two dimensional framework shown in FIG. 21 is erected from a bundle of struts, a portion of which is shown in FIG. 22. The two dimensional framework comprises a number of joined squares having a diagonal within each square. For clarity, only a small section is illustrated in which six squares are involved and which demonstrates how the two dimensional framework thereafter may be manipulated into three dimensional form.

There are eight single hubs designated 600, 601, 602, 603 and 604, 605, 606 and 607 respectively so as to identify them by tiers in the bundle as will be explained in conjunction with FIG. 22. Four split hub assemblies are also shown and indicated by reference characters 608. 609. 610 and 611. The square-bounding rods or struts are designated 612-628 and the diagonals are designated 630–635. The upper hubs of the pairs 608–611 are designated 640–643 respectively whereas their corresponding lower hubs are designated 644–647.

When the framework is in the collapsed, bundle form, there are four tiers or levels of hubs which are designated I', II and II' in FIG. 22. All of the hubs 600–603 are tier I hubs whereas all of the hubs 604–607 are tier Ii hubs. In addition, the hubs 644, 646 and 647 hubs are tier II hubs and the hubs 641 and 643 are tier I hubs. Because the diagonal strut 631 is connected at one end to a tier II hub 604, the hub 640 at its other end is a tier I' hub because of the length of the diagonal strut 630. A similar situation prevails for the hub 642 because the strut 634 connects to the tier II hub 605 and to the hub 642. On the other hand, any diagonal strut which connects to a tier I hub must connect to a tier II' hub at its other end. This is illustrated in FIG. 22 for the four struts and five hubs chosen to indicate the four tiers without confusion. When the complete bundle of struts and hubs is spread out to lie in two dimensional form as in FIG. 21 and the split hub assemblies 608–611 are each joined, the two dimensional configuration can be hingedly manipulated. For example, the three lower squares may be lifted upwardly about the hinge connection coincidental with the aligned struts 626, 627 and 628 so that the three upper squares form a first flat panel assembly and the lower three squares form another flat panel assembly in "V" form with the first flat panel. This could be useful in forming, say, a room divider simply by placing the two flat panel assemblies vertically so that one end of the "V" rests on the supporting surface. The effective size of this unit is adjusted simply by altering the included angle of the "V" between small values less than 90° and large values greater than 90°. By adding to the pattern of FIG. 21, a zig-zag room divider is possible.

Alternatively, the two right-hand squares may be hinged upwardly about the hinge axis coincidental with the aligned struts 623, 625 and the two left-hand squares may be hinged upwardly about the hinge axis coincidental with the aligned struts 622, 624 until the three hubs 600, 604 and 602 are in contact with the respective hubs 607, 611 and 606. One or more of these respective hubs are joined (i.e., any one or all of the hub pairs 600, 607 and 602, 606 and 604, 611 (643, 647) now become split hub assemblies) so that a rigid triangular beam, two squares long, is formed. Obviously, the beam length may be increased by adding the appropriate struts and hubs to the pattern of FIG. 21.

It should also be noted that if the pattern contained additional squares at the right-hand side of FIG. 21, say a doubling of the pattern shown, there would be a second rigid triangular beam joined to the first beam but upside down with respect to same. Obviously, the pattern of FIG. 21 may be expanded both vertically and horizontally to suit particular needs.

Figure 8:
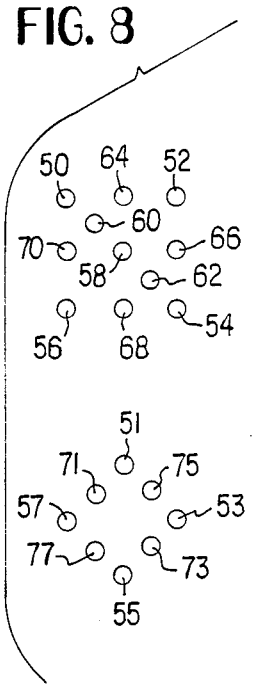
FIG. 8 is a diagram illustrating the relative positions of the hubs of the assembly of FIG. 7 when collapsed.

With regard to the frameworks disclosed herein, but not limited only to those illustrated in the drawing Figures, there is wide latitude in choosing the form of the collapsed bundle of rod elements or struts. The description above concerning FIGS. 7 and 8 on the one hand and FIGS. 9 and 10 on the other hand showed that although the space frames of FIGS. 7 and 9 are substantially identical, the manner of connecting the struts at the split hubs controls the length of the bundle. In FIGS. 7 and 8, the bundle length is approximately equal to the strut length (two tiers of hub means) whereas in FIGS. 9 and 10 the bundle length is approximately three times the strut length (four tiers of hub means). The general rule to be followed is that when (as in FIG. 7) the exterior hubs of each split hub pair are used to connect to the interior struts extending between the two principal surfaces, the bundle length will be commensurate with the strut length, but when (as in FIG. 9) the interior hubs of each split hub pair are used to connect to the interior struts extending between the two principal surfaces, the bundle length will be maximum (i.e., commensurate with three strut lengths). It should also be noted that when, as in FIG. 23, the exterior hub of a split pair at one principal surface is connected to the interior struts while the interior hub of a split pair at the other principal surface is connected to the other ends of these interior struts, then the bundle length will be commensurate with twice the strut length.

It should also be noted that bundle length may also be reduced by separating off all struts defining a principal surface. This requires that where struts defining such principal surface connect to an interior hub of a split pair which also connects to one or more interior struts, that hub must be made detachable to separate these two groups of struts so that the split hub assembly now contains three hubs, the exterior hub and control hub being connected only to the principal surface struts. These two hubs, forming a split hub assembly are separated from the third hub with, as noted, is connected only to interior struts, and when disconnected from each other, allow the surface strut assembly (now two dimensional) to be collapsed as a separate bundle.

Bundle length may also be increased by adding another space frame layer to the structure, i.e., by adding struts defining a further principal surface and interior struts to one or both of the initial principal surface. Struts duplicating the principal surface to which the layer is added are not used in the layer. The bundle is increased in length according to the added space frame layer and, since the added layer does not duplicate the principal surface struts of one principal surface, the layer may be simply plugged onto the space frame to which it has been added if the increase in bundle length is not desired.

What is claimed is:

1. A structural framework which is capable of being manipulated between a collapsed condition and an expanded, two dimensional locked condition, which comprises;

a plurality of rod elements which are disposed generally parallel and in a bundle when said framework is in collapsed condition and each rod element having hub means at each of its ends, said hub means pivotally joining said rod elements so that said rod elements expand into a two dimensional pattern of panels with certain of said hub means defining pairs of superposed split hub assemblies, and means for locking said hub means of the split hub assemblies together to maintain the framework in expanded condition.

2. A structural framework as defined in claim 1 wherein said pattern includes aligned rod elements defining at least one pivot axis between adjacent panels in said pattern.

3. A structural framework as defined in claim 2 wherein there are at least three of said panels.

4. A structural framework as defined in claim 3 including means for joining said panels in triangular configuration.

5. A structural framework which is capable of being manipulated between a collapsed condition and an expanded, locked condition, which comprises:

a plurality of rod elements which are disposed generally parallel and in a bundle when said module is in collapsed condition and each rod element having a hub means at each of its ends for pivotally connecting the respective rod element to the ends of a further two rod elements, the hub means constituting the sole means pivotally joining said rod elements to each other with pairs of certain hubs means constituting superposed split hub assemblies in the expanded condition of the framework to define a plurality of generally pentahedral and a plurality of generally tetrahedral bodies bounded along their edges by rod elements and at their corners by hub means so that the volume enclosed by the framework is filled with such generally pentahedral and generally tetrahedral bodies; and means for locking said pairs of certain hub means together to maintain the framework in expanded condition.

6. A structural framework as defined in claim 5 wherein the framework when expanded defines a plurality of generally octahedral bodies of rod elements each constituting a pair of said generally pentahedral bodies disposed in inverted base-to-base relation to each other.

7. A structural framework as defined in claim 6 wherein the framework defines opposite faces within which triangular arrangements of rod elements generally lie, the triangular arrangements belonging to opposite sides of said generally octahedral bodies of rod elements.

8. A structural framework as defined in claim 7 wherein said generally tetrahedral bodies of rod elements rae defined between peaks of said generally pentahedral bodies of rod elements.

9. A structural framework as defined in claim 6 wherein said generally tetrahedral bodies of rod elements are defined between peaks of said generally pentahedral bodies of rod elements.

10. A collapsible/expandable structural framework comprising a plurality of struts and a plurality of hub means pivotally connected to the ends of said struts, the hub means constituting the sole means pivotally joining the struts so that the framework is movable between a generally parallel and bunched collapsed condition and an expanded condition in which the struts define an open space frame encompassing a volume filled with adjacent and contiguous generally polyhedral bodies each having struts lying along its edges and hub means at its corners so that adjacent bodies share common struts and hub means.

11. A collapsible/expandable structural framework as defined in claim 10 wherein certain pairs of said hub means each define a superposed split hub assembly when the frameork is in expanded condition, and means for joining said hub means of each pair defining a split hub assembly to maintain the framework in expanded condition.

12. A collapsible/expandable structural framework as defined in claim 11 wherein said generally polyhedral bodies include generally tetrahedral bodies.

13. A collapsible/expandable structural framework as defined in claim 12 wherein said generally polyhedral bodies include generally pentahedral bodies.

14. A collapsible/expandable structural framework as defined in claim 13 wherein said generally polyhedral bodies include generally octahedral bodies.

15. A collapsible/expandable structural framework as defined in claim 11 wherein said generally polyhedral bodies include generally pentahedral bodies.

16. A collapsible/expandable structural framework as defined in claim 11 wherein said generally polyhedral bodies include generally octahedral bodies.

17. A collapsible/expandable structural framework as defined in claim 10 wherein said generally polyhedral bodies include generally tetrahedral bodies.

18. A collapsible/expandable structural framework as defined in claim 17 wherein said generally polyhedral bodies include generally pentahedral bodies.

19. A collapsible/expandable structural framework as defined in claim 18 wherein said generally polyhedral bodies include generally octahedral bodies.

20. A collapsible/expandable structural framework as defined in claim 10 wherein said generally polyhedral bodies include generally pentahedral bodies.

21. A collapsible/expandable structural framework as defined in claim 20 wherein said generally polyhedral bodies include generally octahedral bodies.

22. A collapsible/expandable structural framework comprising a plurality of struts and a plurality of hub means connected to ends of said struts for pivotally connecting said struts and constituting the sole means pivotally connecting the struts so that the framework is movable between a collapsed condition and an expanded condition in which the struts, together with the hub means, bound the outlines of a plurality of generally polyhedral shapes sharing common hub means and common struts, which polyhedral shapes are in packed, contiguous and adjacent relation within a volume defined and occupied by said structural framework in its expanded condition.

23. A collapsible/expandable structural framework as defined in claim 22 wherein said polyhedral shapes include tetrahedral shapes.

24. A collapsible/expandable structural framework as defined in claim 23 wherein said polyhedral shapes also include pentahedral shapes.

25. A collapsible/expandable structural framework as defined in claim 23 wherein said polyhedral shapes also include octahedral shapes.

26. A collapsible/expandable structural framework as defined in claim 22 wherein said polyhedral shapes include pentahedral shapes.

27. A collapsible/expandable structural framework as defined in claim 22 wherein said polyhedral shapes include octahedral shapes.

28. In a collapsible/expandable assembly comprising a plurality of modules each comprising a plurality of struts and hub means for pivotally interconnecting the struts, the struts collectively being capable of collapse into a bundle of generally parallel struts and expansion from such bundle into a pattern of expanded, spaced and contiguous modules defining a structural framework, the assembly including pairs of locking struts in which each such pair is deployed from parallel relation when the assembly is bundled into straight line relation when the assembly is expanded, and means for manually locking each such pair of locking struts in such straight line relation.

29. In a collapsible/expandable assembly as defined in claim 28 wherein the pairs of locking struts when in straight line condition for each pair thereof are disposed in parallel relation within the assembly.

30. In a collapsible/expandable assembly as defined in claim 28 wherein the pairs of locking struts when in straight line condition for each pair thereof are disposed in parallel and in orthogonal relations within the assembly.

* * * * *